United States Patent [19]

Tungatt

[11] Patent Number: 4,972,899

[45] Date of Patent: Nov. 27, 1990

[54] METHOD AND APPARATUS FOR CASTING GRAIN REFINED INGOTS

[75] Inventor: Paul D. Tungatt, Middletown, Conn.

[73] Assignee: Olin Corporation, New Haven, Conn.

[21] Appl. No.: 459,603

[22] Filed: Jan. 2, 1990

[51] Int. Cl.[5] ..... B22D 27/04; B22D 11/10

[52] U.S. Cl. ..... 164/459; 164/418; 164/485; 164/338.1; 164/900; 222/592

[58] Field of Search ..... 164/418, 485, 443, 338.1, 164/459, 348, 437, 488, 900; 222/591, 592, 593

[56] References Cited

U.S. PATENT DOCUMENTS 4,577,676 3/1986 Watson .

FOREIGN PATENT DOCUMENTS 63-63566 3/1988 Japan ..... 222/592

OTHER PUBLICATIONS

"Influence of Coarsening on Dendrite Arms Spacing of Aluminum-Copper Alloys", by Kattamis et al, Transactions of the Metallurgical Society of AIME, vol. 239, Oct., 1967, pp. 1504–1511.

"On the Origin of the Equiaxed Zone in Castings"by Jackson et al, Transactions of the Metallurgical Society of AIME, vol. 236, Feb. 1966, pp. 149–157.

*Primary Examiner*—Kuang Y. Lin

*Attorney, Agent, or Firm*—H. Samuel Kieser

[57] ABSTRACT

A method and apparatus for casting a grain refined ingot from a metallic melt supplied to a casting mold through a feed tube. The feed tube is provided with at least one cooling passageway through which a cooling fluid cyclically flows to form a zone of fine dendrites on the inner peripheral surface of the mold. An inductor is provided to reheat the zone of fine dendrites to detach dendrite arms into the melt which serve as nuclei for grain refinement as the melt solidifies into a cast ingot in the mold.

12 Claims, 1 Drawing Sheet

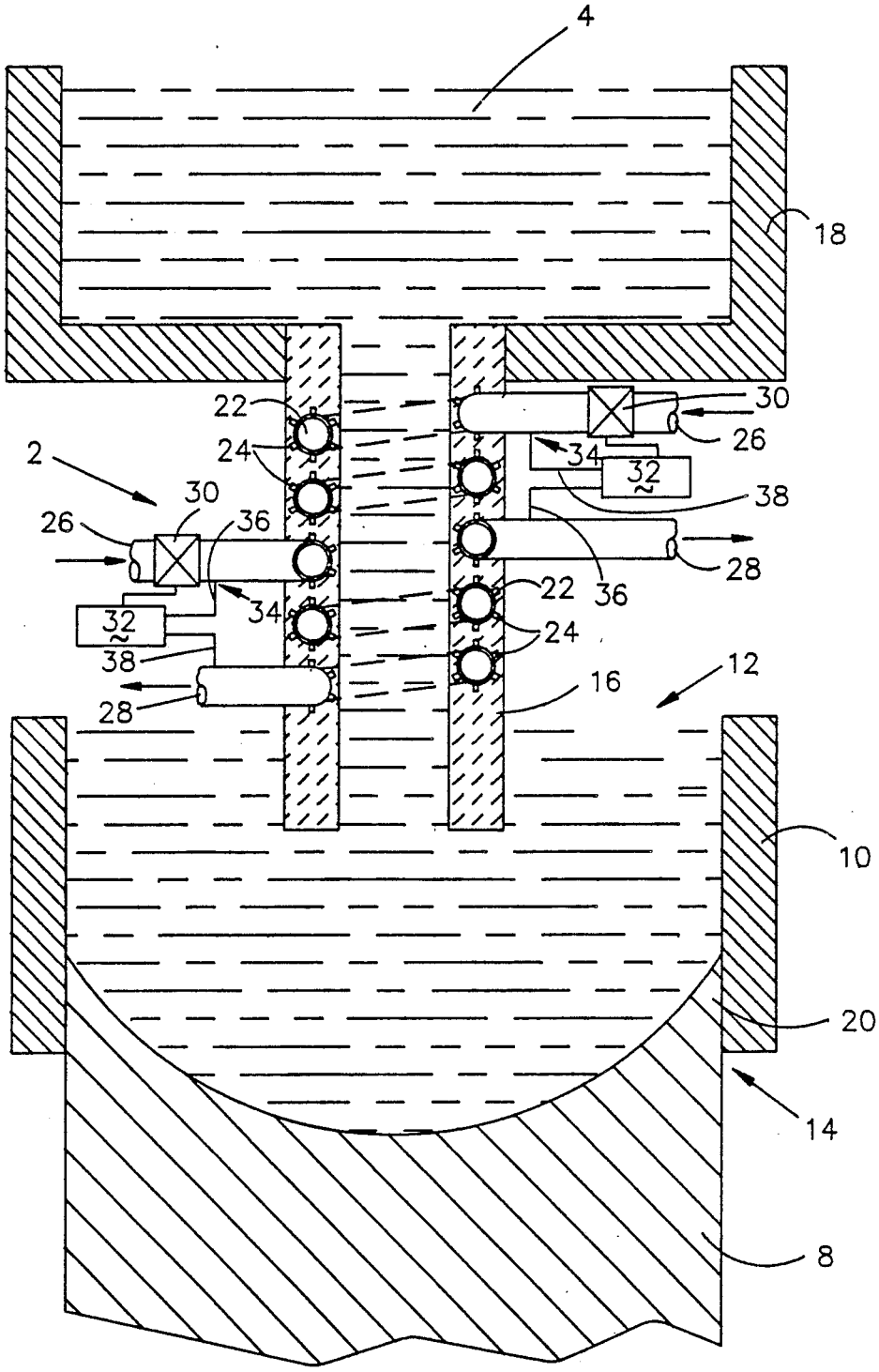
4
18
22
24
30
26
34
32
38
2
30
26
36
28
22
36
34
32
24
38
28
16
12
10
20
14
8

METHOD AND APPARATUS FOR CASTING GRAIN REFINED INGOTS

This invention relates generally to the casting of ingots having a refined grain structure. More particularly, it relates to a method and apparatus for casting ingots in which secondary dendrite arms are detached and mixed with a molten alloy melt. As the melt solidifies the detached dendrite arms serve as nuclei and create a cast ingot with a refined grain structure.

U.S. Pat. No. 4,577,676, issued Mar. 25, 1986 to William G. Watson discloses a method and apparatus for casting an ingot with a refined grain structure. As mentioned in that patent, the literature abounds with grain refining theories which involve secondary dendrite arm detachment concepts. As disclosed in an article entitled "Influence of Coarsening on Dendrite Arms Spacing of Aluminum-Copper Alloys" by Kattamis et al., Transactions of the Metallurgical Society of AIME, Vol. 239, October, 1967, pages 1504–1511, proposed mechanisms include isothermal coarsening with detachment of secondary arms from the primary spine due to curvature effects at the root of the secondary arms. Another mechanism suggested in an article entitled "On the Origin of The Equiaxed Zone in Castings" by Jackson et al., Transactions of the Metallurgical Society of AIME, Vol. 236, February, 1966, pages 149–157, is secondary dendrite arm separation by melting within highly segregated regions during reheat cycles associated with random thermal fluctuations occurring during solidification. The theories set out in the literature are directed to random detachment of secondary dendrite arms.

The invention described in U.S. Pat. No. 4,577,676 is directed to a specific apparatus for forming the fine dendrites and a specific technique to control the detachment of the secondary arms. Specifically, U.S. Pat. No. 4,577,676 discloses intermittently cooling a section of a casting mold to form a narrow zone of dendrites having secondary dendrite arms on an inner peripheral surface of the mold. The zone is then allowed to reheat whereby the secondary dendrite arms are detached from the dendrites. The detached dendrite arms are mixed into the melt to serve as nuclei for grain refinement as the alloy solidifies into the cast ingot.

In order to accomplish the desired result according to the disclosure of U.S. Pat. No. 4,577,676, it is necessary that the casting mold be extensively modified due to the necessity for providing an insulated section and the provision of a narrow zone to which an intermittent cooling spray is applied. Additionally, due to the intermittent cooling of the copper mold, there may be dimensional and tolerance problems in the mold apparatus as well as flexing of the copper mold itself. Further, during the cooling period when the dendrites are growing, there is no nucleation taking place and, accordingly, there may be an uneven dispersion of the grains in the melt.

Accordingly, it is an object of the present invention to provide an improved casting system and process for casting grain refined ingots.

It is another object of the present invention to provide a casting system and process for casting grain refined ingots which overcomes the problems set forth above.

More specifically, it is an object of the present invention to provide a method and apparatus for producing cast ingots having refined grain structure which requires substantially no changes to existing mold design.

Yet another object of the present invention is to provide a system for casting a metallic melt into an ingot with refined grain structure, wherein there is provided a continuous supply of nucleating grains during the casting operation.

These and other objects and advantages of the present invention may be accomplished through a method for producing a cast metallic ingot having refined grain structure which includes the steps of providing a casting mold and supplying a metallic melt to the mold through a feed tube. A section of the feed tube is intermittently cooled to form a zone of fine dendrites having secondary dendrites on the inner peripheral surface of the tube. The zone of fine dendrites is reheated by induction heating to detach secondary arms from the fine dendrites and the melt solidifies in the mold into a cast ingot having a relatively refined grain structure.

An apparatus for casting a metallic ingot having a refined grain structure in accordance with the present invention may comprise a direct chill casting mold having an inlet section and outlet section. A feed tube communicates with the inlet for directing a melt into the mold. Means are provided for intermittently cooling a section of the feed tube for partially solidifying the melt to form a zone of dendrites on the inner peripheral surface of the feed tube. Induction heating means are provided for heating the zone of dendrites to detach secondary arms into the melt.

The present invention may be more readily understood by reference to the following detailed description and to the accompanying drawing in which:

The FIGURE is a schematic representation of a direct chill casting system in accordance with the present invention.

Referring to the drawing, there is shown an apparatus 2 for casting a molten metallic material or melt 4 into an ingot 8 having a relatively refined grain structure. The apparatus 2 includes a casting mold 10 having an inlet section 12 and an outlet section 14. The casting mold 10 is a conventional direct chill mold and may be constructed of any suitable material such as copper or the like.

A feed tube 16 extends from a pouring box or tundish 18 to the inlet section 12 of the mold 10 for feeding the molten metallic material or melt 4 from the tundish 18 into the mold 10. As the melt 4 passes through the mold 10, a hardened outer shell 20 forms against the interior peripheral surface of the mold 10. The interior of the cast metal within the mold 10 is molten. As the the ingot 8 exits from the outlet section 14 of the mold, water is sprayed on the sides of the ingot 8, cooling it and causing the contained molten metal to solidify.

In accordance with the present invention, the feed tube 16 may be provided with means for cooling the melt adjacent the inner peripheral wall of the feed tube 16 to cause it to partially solidify and also with means for causing the partially solidified metal to be actively reheated. For reasons set forth below, there are two sets of essentially identical cooling/reheating means having the same reference numerals in the drawings. The cooling of the melt may be accomplished by embedding a coil of cooling tube 22 of copper or other suitable material having a high coefficient of thermal conductivity in the feed tube 16. The feed tube 16 is preferably made from a heat resistant material such as graphite or a ceramic having a high silicon carbide content. The cooling tube 22 may be provided with fins 24 extending radially outwardly to enhance the rate of heat transfer. The cooling tube 22 has an inlet 26 connected to a source (not shown) of cooling fluid such as water or other suitable fluid and an outlet 28 through which the cooling fluid exits. A valve 30 may be positioned in the inlet 26 for controlling the rate of flow of the cooling fluid as well as the on-off condition thereof. The valve 30 may be activated by an appropriate timer mounted in a control system 32 to provide for the intermittent or cyclical flow of the cooling fluid through the cooling tubes 22.

To provide for the active reheating of the partially solidified melt, an inductor 34 is provided which surrounds the melt passing through the feedtube 16. The inductor 34 may be formed by connecting the copper tube 22 to a suitable source of A.C. power through the control system 32 by electrical connectors 36,38 so that an A.C. current is caused to pass through the cooling tube 24 from one end to the other. The A.C. current passing in the cooling tube 24 around the melt in the feed tube 16 produces a time varying magnetic field which induces a current in the partially solidified melt which generates heat to partially remelt the partially solidified shell along the inner wall of the feed tube 16. The control system 32 provides a means for adjusting the application of the A.C. current to the coil 22 so that the current is intermittently or cyclically applied in relation to the intermittent pausing of the flow of cooling fluid through the coil 22.

According to a preferred embodiment of the present invention, there are a plurality of cooling/reheating means provided in the feed tube 16. As shown in the drawing, there are two such means to provide two cooling/reheating zones, one above the other in the feed tube 16. Each zone has its own cooling tube 22 with an associated control valve 26 and a separate connection to the A.C. power source. The flow of cooling fluid and application of reheat A.C. current in each means is independently controlled, but in relation to each other, thereby forming two independent but interrelated cooling/reheating zones along the feed tube 16. Each cooling/reheating means may have its own control system 32, or be connected to a common control system that provides for the independent, but related, operation of both cooling/reheating means.

The present invention well be better understood by the following description of the operation of the apparatus. A molten metal or metal base alloy 4 is fed from the pouring box 18 into the inlet section of the 12 of the mold 10 through the feed tube 16. Cyclical high heat transfer (cooling)/reheating is applied to the melt in the area adjacent the inner wall of the feed tube to cyclically partially solidify the melt and then reheat it. The partial solidification is effected by intermittently passing cooling fluid through the coil of cooling tube 22. The pulse time and quantity of the cooling fluid may be controlled by the valve 32 which may be connected to the control system 36.

During the high heat transfer cycle, i.e. while cooling fluid is passing through the cooling tube 22 and the melt partially solidifies, a zone of dendrites with secondary arms forms on the inner peripheral surface of the feed tube 16. The dendrites attach to the feed tube wall and grow outwardly toward the interior of the feed tube 16. The growth of this zone of fine dendrites continues while the feed tube 16 is subjected to the high heat transfer cycle.

At the end of a predetermined time, the cooling fluid is turned off by closing the valve 32, and an A.C. current is applied to the cooling tube coil 22 starting the reheating cycle. During the reheating cycle, the partially solidified melt is heated, causing it to remelt. During the remelting the dendrite arms are detached and mix into the melt and serve as nuclei for grain refinement during the subsequent solidification of the melt into a cast ingot.

The detachment of the dendrite arms is thought to occur in one of two ways. First, the secondary arms might melt near the point of attachment to the primary dendrites and detach as the dendritic zone is reheated during the reheat cycles. A second possibility is the detachment of the dendrite arms by isothermal coarsening. This phenomena, which may occur when the interior melt temperature is not significantly above the equilibrium liquidus temperature, results in the detachment of the smaller dendrite arms. One theory, as set forth in the article by Kattamis et al, suggests that the smaller dendrite arms detach by the transport or "melt off" of material from the smallest portion of the secondary arm at its point of attachment to the primary dendrite.

Once the dendrite arms are detached, they begin to move downstream in the direction of the molten metal or alloy flow. Due to the fact that the reheating is accomplished by induction heating through the use of an inductor, there will be some electromagnetic stirring of the melt within the feed tubes, thereby enhancing the distribution of the dendrite arms throughout the melt in order that the solidified ingot has a more homogeneous refined grain structure.

With the provision of two sets of cooling/reheating means, the correlation of operation betweeen the two sets is such that as one set is functioning to cause the growth of dendrites, the other set is functioning to release dendrites into the flow of melt which has not received dendrite arms from the other set. This also helps to create a better distribution of dendrite arms throughout the melt.

After the melt passes from the feed tube into the mold, it begins to solidify against the inner peripheral surface of the mold. The solidification occurs when nuclei, such as the detached dendrite arms, approach the liquid solid interface and begin to grow into the solidified ingot. The nuclei provide grain refinement during the in-mold solidification. The result is a relatively homogeneous distribution of small, equiaxed grains as opposed to the coarse dendritic structure which occur in the typical direct chill casting.

What is claimed is:

1. A method for producing a cast metallic ingot having refined grain structure utilizing a casting mold and a feed tube through which a metallic melt is supplied to said casting mold, said method comprising:

(a) intermittently cooling a section of said feed tube to form a zone of a plurality of fine dendrites on the inner peripheral surface of said feed tube;

(b) reheating said zone of fine dendrites by induction heating to detach secondary dendrite arms from said dendrites; and (c) solidifying said melt into a cast ingot having a relatively refined grain structure.

2. The method of claim 1 wherein said step of intermittently cooling includes intermittently passing a cooling fluid through cooling passages in said feed tube.

3. The method of claim 2 wherein said cooling passages comprise a coil of copper tubing embedded in said feed tube.

4. The method of claim 3 wherein said step of reheating includes passing an A.C. current through said coil.

5. The method of claim 1 wherein two sections of said feed tube are independently cooled to form at least two zones of dendrites which are independently reheated.

6. The method of claim 5 wherein one section of said feed tube is cooled to form a zone of dendrites while another zone of dendrites is being reheated.

7. An apparatus for casting a metallic ingot having a refined grain structure comprising:

(a) a direct chill casting mold having an inlet section and an outlet section;

(b) a feed tube for directing a melt into said inlet section;

(c) means for intermittently cooling said feed tube to form a zone of dendrites on the inner periphery of said tube; and (d) means for intermittently actively reheating said zone to detach dendrite arms into the melt.

8. The apparatus of claim 7 wherein said means for cooling comprises means for passing a cooling fluid through cooling passages in said feed tube.

9. The apparatus of claim 8 wherein said cooling passages comprise a coil of copper tubing embedded in said feed tube.

10. The apparatus of claim 7 wherein the means for reheating comprises an inductor.

11. The apparatus of claim 9 wherein the means for reheating comprises means for passing an A.C. current through said copper coil.

12. The apparatus of claim 7 wherein there are two independent sets of means for cooling said feed tube and for intermittently actively reheating said zone, the cooling means of one set cooling said melt while the means for reheating of the other set is reheating.

* * * * *